US005108884A

United States Patent [19]

Shibata et al.

[11] Patent Number: 5,108,884

[45] Date of Patent: Apr. 28, 1992

[54] ANTISTATICALLY FINISHED SILVER HALIDE PHOTOGRAPHIC PHOTOSENSITIVE MATERIAL

[75] Inventors: Yoshio Shibata; Seiichi Sumi, both of Nagaokakyo, Japan

[73] Assignee: Mitsubishi Paper Mills Limited, Tokyo, Japan

[21] Appl. No.: 674,917

[22] Filed: Mar. 26, 1991

[30] Foreign Application Priority Data

Mar. 30, 1990 [JP] Japan ..... 2-83107

[51] Int. Cl.[5] ..... G03C 1/76

[52] U.S. Cl. ..... 430/523; 430/529; 430/626

[58] Field of Search ..... 430/523, 529, 626

[56] References Cited

U.S. PATENT DOCUMENTS

| | | | |
|---|---|---|---|
| 2,725,297 | 11/1955 | Morey | 430/529 |
| 3,026,201 | 3/1962 | Rauch et al. | 430/611 |
| 3,325,287 | 6/1967 | Yamamoto | 430/626 |
| 3,681,070 | 8/1972 | Timmerman et al. | 430/62 |
| 4,388,402 | 6/1983 | Mukunoki et al. | 430/529 |
| 4,916,054 | 4/1990 | Yoneyama et al. | 430/529 |

*Primary Examiner*—Jack P. Brammer

*Attorney, Agent, or Firm*—Cushman, Darby & Cushman

[57] ABSTRACT

The present invention provides a siliver halide photographic photosensitive material which comprises a base, at least a silver halide emulsion layer provided on the base and at least a back coat layer comprising a gelatin containing a polymer mainly composed of styrenesulfonic acid provided on another side of the base wherein said back coat layer additionally contains a surface active agent represented by the following formula [I] and is hardened with a triazine.

$$R-O\text{-}(CH_2CH_2O)_n\text{-}SO_3M \qquad [I]$$

wherein n is a natural number of 1-20, M represents a hydrogen atom or an alkali metal, and R represents an alkyl group of 5-15 carbon atoms, or

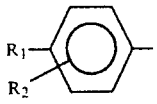

in which $R_1$ represents an alkyl group of 5-15 carbon atoms and $R_2$ represents an alkyl group of 1-3 carbon atoms, a hydrogen atom or a halogen atom. Said back coat layer is excellent in antistatic properties, adhesion to a base and drying properties.

3 Claims, No Drawings

ANTISTATICALLY FINISHED SILVER HALIDE PHOTOGRAPHIC PHOTOSENSITIVE MATERIAL

BACKGROUND OF THE INVENTION

The present invention relates to a silver halide photographic photosensitive material and more particularly, to an antistatic back coat layer.

In silver halide photographic photosensitive materials, a film, a paper and the like are used as a base, but these are low in electrical conductivity and have various problems.

One of these problems is that when a coating solution containing silver halide is coated on a film or a paper, this is coated at a high speed by a coater, but the film or paper is electrically charged while being rubbed with a roller and if discharging occurs, the silver halide is fogged (static fogging). If the back coat layer is enhanced in electrical conductivity and is imparted with antistatic properties, since the back coat layer is usually coated before coating of silver halide emulsion, this back coat layer causes, through the base, improvement of antistatic properties of the surface to be coated with emulsion which is opposite side to the back coat side and as a result, the static fogging can be inhibited.

Another problem is that when users use photosensitive materials, if these are statically charged, dusts stick to the photosensitive materials and often cause formation of undesirable images such as pin holes during the courses of exposure and photographic treatments and furthermore, may cause adhesion of the photosensitive materials to each other to deteriorate operability. Further problem is that these photosensitive materials discharge through hands.

It is important that photosensitive materials must have good antistatic properties before and after the treatment such as development, fixation and water washing.

Japanese Patent Kokai Nos. 56-92535 and 61-174542 disclose that an antistatic layer is provided between a back coat layer and a base to increase antistatic properties through this layer and besides, an aziridine hardener is used for improvement of adhesion between the antistatic layer and the back coat layer. However, the aziridine hardener causes eruption on the skin and use thereof is not desired for safety and sanitary reasons In addition, there is the problem that since an antistatic layer is provided between a base and the back coat layer, adhesion of the back coat layer is not sufficient and besides, dryness is poor

SUMMARY OF THE INVENTION

The object of the present invention is to provide a back coat layer having good antistatic properties and furthermore to provide a back coat layer having good adhesion and drying characteristics.

The above object of the present invention has been attained by a back coat layer comprising a gelatin containing a polymer mainly composed of styrenesulfonic acid wherein the back coat layer contains a surface active agent represented by the following formula (1) and is hardened with a triazine.

$$R-O\leftarrow CH_2CH_2O\rightarrow_n SO_3M \qquad [I]$$

wherein n is a natural number of 1-20, M represents a hydrogen atom or an alkali metal, and R represents an alkyl group of 5-15 carbon atoms or

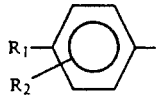

in which $R_1$ represents an alkyl group of 5-15 carbon atoms and $R_2$ represents an alkyl group of 1-3 carbon atoms, a hydrogen atom or a halogen atom.

DESCRIPTION OF THE INVENTION

The polymer mainly composed of styrenesulfonic acid used in the present invention comprises at least 50 mol%, preferably at least 60 mol% of styrenesulfonic acid. If content of the styrenesulfonic acid is less than 50 mol%, action of antistatic agent is not exhibited. Monomers copolymerized with styrenesulfonic acid may be any monomers such as, for example, vinylidene chloride, styrene, maleic acid, propylene, and ethylene as far as the condition of at least 50 mol% being styrenesulfonic acid is satisfied, but preferably, they do not contain quaternary nitrogen. Sodium ion and potassium ion are preferred as counter ions of styrenesulfonic acid. Ammonium salts are not preferred because they damage photographic properties.

Molecular weight of the polymer is preferably 3,000-50,000. If it is less than 3,000, the polymer dissolves away into the processing solution during photographic treatment and deteriorates antistatic properties after treatment and besides, sticks to the photosensitive materials to result in uneven treatment. If the molecular weight is more than 50,000, when the polymer is mixed with gelatin, viscosity increases and it is preferably 20,000 or less.

Addition amount of the polymer is 20-150% based on the weight of gelatin. If it is less than 20%, electrical conductivity is low and antistatic purpose cannot be attained. If it is more than 150%, even when any hardeners are used in any amounts, degree of hardening is not enough to perform function as a back coat layer of photographic materials.

As disclosed in U.S. Pat. Nos. 2,725,297 and 3,681,070 and Japanese Patent Kokai No. 61-17453, it is known to use these polymers mainly composed of styrenesulfonic acid as antistatic agents. Representative polymers among these polymers are put on sale as Chemistat from Sanyo Kasei Co. and as Barsa TL from Kanebo Chemical Co.

The surface active agent of the formula [I] used in the present invention is disclosed in U.S. Pat. No. 3,026,201, but this patent makes no mention of matching between the surface active agent of the formula [I] and the mixture of the polymer mainly composed of styrenesulfonic acid and gelatin.

In the formula [I], n is preferably 20 or less. If it is more than 20, coating properties deteriorate and n is especially preferably 3-15. The alkyl group of R has 5-15 carbon atoms. If the carbon number is less than 5, the role of a surface active agent is not filled and coating properties deteriorate and thus, there are problems in practical use. If it is more than 15, oleophilicity is too strong resulting in uneven coating. The carbon number of the alkyl group is especially preferably 8-12. The alkyl group of $R_1$ is the same as that of R. M is a hydrogen atom or an alkali metal and is especially preferably sodium and potassium ions. $R_2$ is an alkyl group of 1-3 carbon atoms, a hydrogen atom or a halogen atom.

Addition amount of the surface active agent is preferably 0.05-10 g and especially 0.5-5.0 g per 1 liter of coating solution. The surface active agent may be added at any stage.

Examples of the surface active agent [I] are shown below.

Exemplified Compounds [I]

$H_{15}C_7-O\leftarrow CH_2CH_2O\rightarrow_{15}SO_3Na$ I-a $H_{27}C_{13}-O\leftarrow CH_2CH_2O\rightarrow_{14}SO_3Na$ I-b

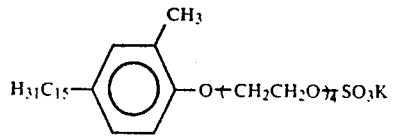

I-c

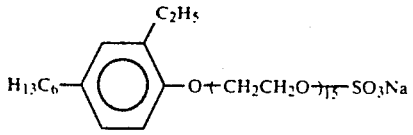

I-d

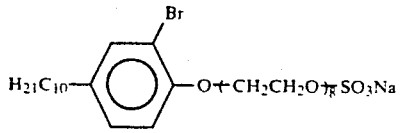

I-e

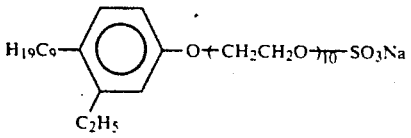

I-f

The triazine hardener used in the present invention is represented by the following formula [II]:

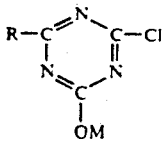

(II)

wherein R represents Cl or OH and M represents a hydrogen atom or an alkali metal ion.

It is preferred to add 10 mg-500 mg of the triazine hardener per 1 g of gelatin and especially preferred is 50 mg-150 mg. When this is added just before coating, effect of hardening is further increased.

The polystyrenesulfonic acid, the surface active agent of the formula [I] and the triazine hardener are known, but the feature of the present invention is that only when these are used in combination, excellent antistatic properties, adhesion to a base and drying properties can be obtained.

Gelatine used in the present invention is not critical, but is preferably inert gelatin, especially preferably one from which calcium ion is removed

EXAMPLE 1

Back coating solutions (A) were prepared in the following formulation.

| Solution (A): | |
|---|---|
| Water | 800 ml |
| Gelatin | 50 g |
| 1% Acid Violet (Adel Haen Co.) | 50 ml |
| Various surface active agent (10%) | 20 ml |
| Varsa TL3 (Kanebo . N.S.C Co.) | 50 g |
| Various hardeners (10%) | 30 ml |
| Water to make up 1 liter. | |

As surface active agent, those which are shown in Table 1 were selected.

TABLE 1

| No. | Name | Name of maker | Type |
|---|---|---|---|
| I-a | Aerol OP | Toho Chemical Co. | anionic |
| I-b | Actinol K | Matsumoto Yushi Co. | nonionic |
| I-c | Zontes TL | Matsumoto Yushi Co. | cationic |
| I-d | Sanstat 1007 | Sanyo Kasei Co. | amphoteric |
| I-e | Compound I-a | — | polyethylene oxide anionic |

Each of these surface active agents was dissolved in water at a concentration of 10% and 20 ml of the solution was added to solution (A).

As hardeners, those which are shown in Table 2 were used.

TABLE 2

| No. | Name | Structural formula | Type |
|---|---|---|---|
| 2-a | Triazine | 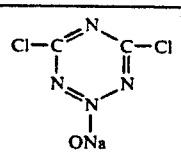 | Active halogen |
| 2-b | Glyoxal | CHO<br>\|<br>CHO | Aldehyde |
| 2-c | Pyridinium salt | 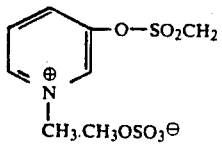 | Carboxy active |

TABLE 2-continued

| No. | Name | Structural formula | Type |
|---|---|---|---|
| 2-d | Vinyl sulfone | $\left(\begin{array}{l} CH_2{=}CH{-}SO_2{-}C_2H_4{-}COHN \\ \qquad\qquad\qquad\qquad\quad \vert \\ \qquad\qquad\qquad\qquad\quad CH{-}\!\!\!-\!\!\!-CH_2 \\ \qquad\qquad\qquad\qquad\quad \vert \\ CH_2{=}CH{-}SO_2{-}C_2H_4{-}COHN \end{array}\right)$ | Active olefin |
| 2-e | Aziridine | $\left\langle\!\!\!

TABLE 3-continued

| Surface active agent | Hardener | Surface resistance (Ω) Before processing | After processing | Drying property | Adhesion | Others |
|---|---|---|---|---|---|---|
| | 2-d | $5.1 \times 10^9$ | $7.6 \times 10^{11}$ | ○ | Δ | Comparative sample |
| | 2-e | $6.8 \times 10^9$ | $9.1 \times 10^{11}$ | ○ | Δ | Comparative sample |
| 1-e | 2-a | $5.1 \times 10^9$ | $2.6 \times 10^{10}$ | ○ | ○ | The sample of the present invention |
| | 2-b | $3.6 \times 10^{10}$ | $8.6 \times 10^{12}$ | Δ | Δ | Comparative sample |
| | 2-c | $8.8 \times 10^{10}$ | Much higher than $10^{12}$ | Δ | X | Comparative sample |
| | 2-d | $3.1 \times 10^{10}$ | $3.6 \times 10^{12}$ | Δ | Δ | Comparative sample |
| | 2-e | $3.3 \times 10^9$ | $5.1 \times 10^{12}$ | ○ | Δ | Comparative sample |

As can be seen from Table 3, when Aerol OP (1-a) was used as the surface active agent, the resistance of the sample before and after subjected to processing was good, but the sample was inferior in adhesion of the coat and besides, the surface active agent reacted with styrene sulfonic acid polymer resulting in precipitate to cause deterioration of coating properties.

When Actinol K (1-b) was used, resistance of the sample after subjected to processing was high and inferior in drying properties. When Sontes TL (1-c) was used, resistance of the sample after subjected to processing was inferior. When Sunstat 1007 (1-d) was used, resistance of the sample was good, but it was inferior in adhesion.

When the compound (1-e) was used, resistance of the sample after subjected to processing was high and inferior in drying properties and adhesion in the case of using glyoxal (2-b), pyridinium salt (2-c) or vinyl sulfone (2-d).

From the above, as far as the polymer mainly composed of styrenesulfonic acid is present in gelatin, the use of the surface active agent [I] and the triazine hardener in combination gives peculiarly excellent effect.

What is claimed is:

1. A silver halide photographic photosensitive material which comprises a base, at least a silver halide emulsion layer provided on the base and on the opposite side of the base, a back coat layer consisting essentially of a gelatin containing a polymer having a molecular weight of 3,000–5,000 and in an amount of 20–150% based on the amount of gelatin, including styrenesulfonic acid wherein said back coat layer additionally contains a surface active agent in an amount of 0.05–10 g per 1 liter of coating solution represented by the following formula [I] and is hardened with a triazine in an amount of 10–500 mg based on 1 g of gelatin $$R-O\text{-}(CH_2CH_2O)_n\text{-}SO_3M \qquad [I]$$

wherein n is a natural number of 1–20, M represents a hydrogen atom or an alkali metal, and R represents an alkyl group of 5–15 carbon atoms or

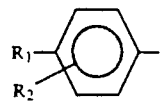

in which $R_1$ represents an alkyl group of 5–15 carbon atoms and $R_2$ represents an alkyl group of 1–3 carbon atoms, a hydrogen atom or a halogen atom.

2. A silver halide photographic photosensitive material according to claim 1 wherein the triazine as a hardener is represented by the following formula [II]:

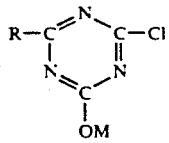

(II)

wherein R represents Cl or OH, M represents a hydrogen atom or an alkali metal ion.

3. A silver halide photographic photosensitive material according to claim 1 wherein the polymer includes homopolymers of styrenesulfonic acid and copolymers comprising at least 50% of styrenesulfonic acid and monomers copolymerizable therewith.

* * * * *